US006719666B1

(12) United States Patent
Lo et al.

(10) Patent No.: US 6,719,666 B1
(45) Date of Patent: Apr. 13, 2004

(54) EXERCISING DEVICE THAT PRODUCES ELLIPTICAL FOOT MOVEMENT

(75) Inventors: Kun-Chuan Lo, No. 3, Ching-Cheng 4th St., Taichung City (TW); Hung-Mao Liao, Taichung (TW); Pei-Ju Chi, Taichung Hsien (TW)

(73) Assignee: Kun-Chuan Lo, Taichung (TW)

( * ) Notice: Subject to any disclaimer, the term of this patent is extended or adjusted under 35 U.S.C. 154(b) by 0 days.

(21) Appl. No.: 10/379,514

(22) Filed: Mar. 5, 2003

(51) Int. Cl.[7] ..... A63B 69/16; A63B 22/04
(52) U.S. Cl. ..... 482/52; 482/57
(58) Field of Search ..... 482/51–53, 57, 482/70, 79, 80

(56) References Cited

U.S. PATENT DOCUMENTS 5,921,894 A * 7/1999 Eschenbach ..... 482/57
6,152,859 A * 11/2000 Stearns ..... 482/52
6,254,514 B1 * 7/2001 Maresh et al. ..... 482/52

* cited by examiner

*Primary Examiner*—Stephen R. Crow
(74) *Attorney, Agent, or Firm*—Trop, Pruner & Hu, P.C.

(57) ABSTRACT

An exercising device includes a hand operated member pivoted to a mounting frame and connected to a first coupler member which proceeds with a first reciprocating movement, and a lever member pivoted to the frame and connected to a second coupler member which proceeds with a second reciprocating movement. The second coupler member has a rear coupling end on which a motion guiding member, that is in slidable contact with the first coupler member, is mounted. A crank member is pivoted to a rear coupling end of the first coupler member. A synchronizing member is disposed to couple the hand operated member with the lever member such that the first and second reciprocating movements are synchronized, thereby rendering the second coupler member to run along an elliptical path.

8 Claims, 5 Drawing Sheets

EXERCISING DEVICE THAT PRODUCES ELLIPTICAL FOOT MOVEMENT

BACKGROUND OF THE INVENTION

1. Field of the Invention

This invention relates to an exercising device which produces an elliptical foot movement, more particularly to an exercising device in which the elliptical foot movement may be varied.

2. Description of the Related Art

A conventional exercising device with an elliptical foot movement generally includes a pair of treading members which can be brought to proceed with a reciprocating movement along an elliptical path. However, the size of the elliptical path in the conventional exercising device is unchangeable, and cannot suit the requirement of different users.

To overcome this drawback, an improved conventional exercising device which can generate a variable elliptical foot path has been developed. One problem of the improved exercising device resides in that distal ends of coupler members for treading by the user will project outwardly of a support frame during exercising, thereby making the exercising device unsafe to use and thereby adversely affecting the outer appearance of the exercising device.

SUMMARY OF THE INVENTION

The object of the present invention is to provide an exercising device which can overcome the aforesaid drawbacks of the prior art.

According to this invention, the exercising device includes a base support which is adapted to be placed on a ground, and which has front and rear portions opposite to each other in a longitudinal direction. A front mounting post is disposed on and extends upwardly from the front portion, and includes lower and upper segments opposite to each other in an upright direction and respectively proximate to and distal from the front portion, and an intermediate segment interposed between the lower and upper segments. A rear mounting post is disposed on and extends upwardly from the rear portion.

A hand operated member is mounted on and is pivotable relative to the upper segment of the front mounting post about a first fulcrum axis, and includes handle and lever portions which are disposed respectively at opposite sides of the first fulcrum axis. The lever portion is swung by the handle portion, extends downwardly, and terminates at a distal end.

A first coupler member includes a first front coupling end which is connected to the distal end, and a first intermediate portion which extends rearwardly from the first front coupling end and which terminates at a first rear coupling end. The first intermediate portion proceeds with a first reciprocating movement when the lever portion is swung.

A crank member includes a crankpin which is pivoted to the first rear coupling end about a first pivot axis parallel to the first fulcrum axis, a crank arm which has a proximate arm end that is connected to the crankpin, and a distal arm end that extends from the proximate arm end radially relative to the first pivot axis, and a crankshaft which is pivoted to the distal arm end about a second pivot axis parallel to the first pivot axis and which is mounted on and which is rotatable relative to the rear mounting post about the second pivot axis.

A lever member includes a proximate lever end which is pivotally mounted relative to the intermediate segment of the front mounting post about a second fulcrum axis parallel to the first fulcrum axis, and a middle lever segment which extends from the proximate lever end and which terminates at a distal lever end.

A second coupler member includes a second front coupling end which is connected to the distal lever end of the lever member, and a second intermediate portion which extends rearwardly from the second front coupling end and which terminates at a second rear coupling end. The second intermediate portion is adapted to be treaded to proceed with a second reciprocating movement in the longitudinal direction, thereby swinging the middle lever segment of the lever member about the second fulcrum axis.

A motion guiding member is connected to the second rear coupling end of the second coupler member, and is in slidable contact with the first intermediate portion of the first coupler member in the longitudinal direction so as to move relative to the first rear coupling end when the second intermediate portion of the second coupler member proceeds with the second reciprocating movement.

A synchronizing member is disposed to couple the distal end of the lever portion with the middle lever segment of the lever member, such that the first and second reciprocating movements are synchronized in the direction of movement, thereby rendering the second coupler member to run along an elliptical path when the crank arm of the crank member rotates about the second pivot axis.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
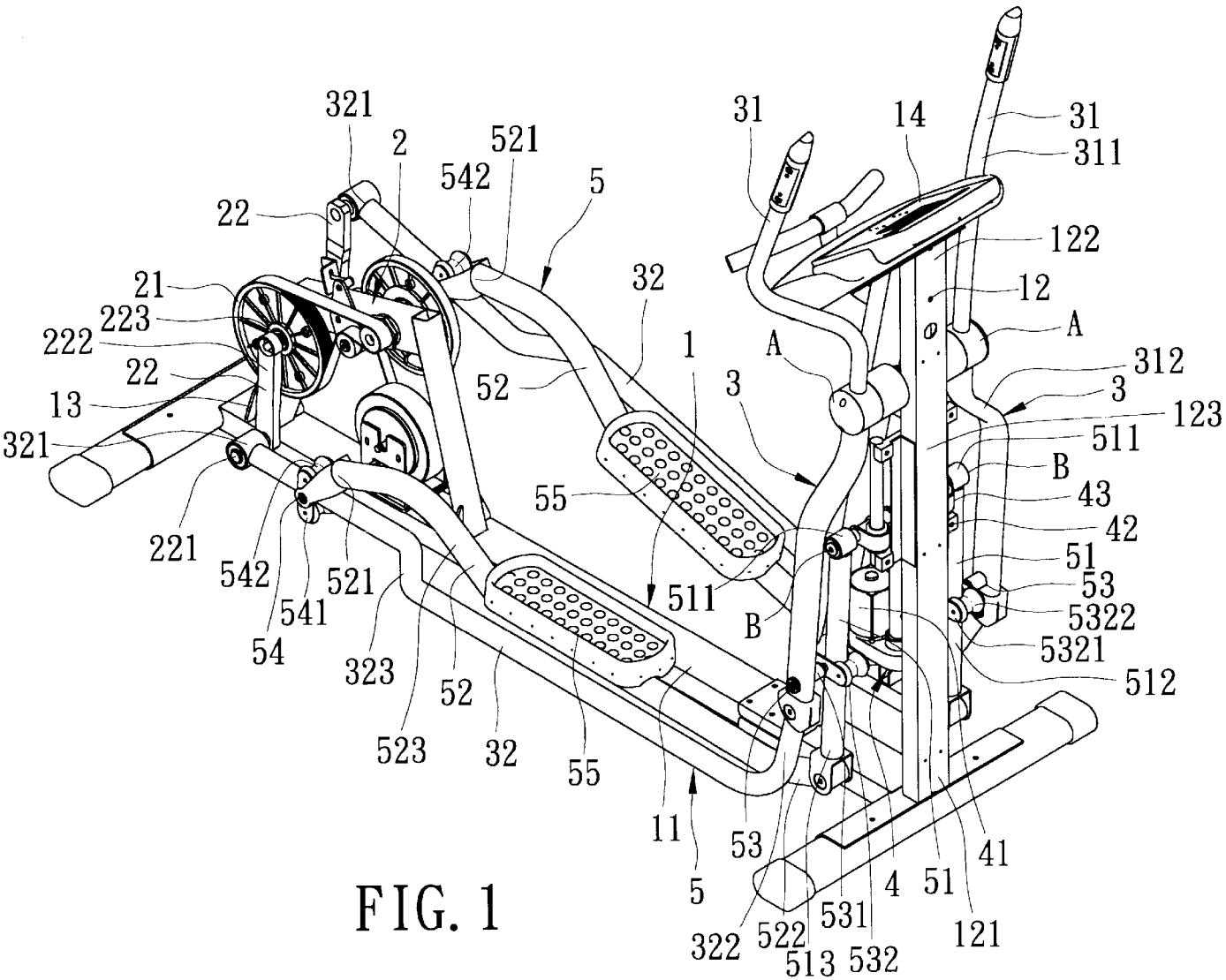
FIG. 1 is a perspective view of a preferred embodiment of an exercising device according to this invention.
Figure 2:
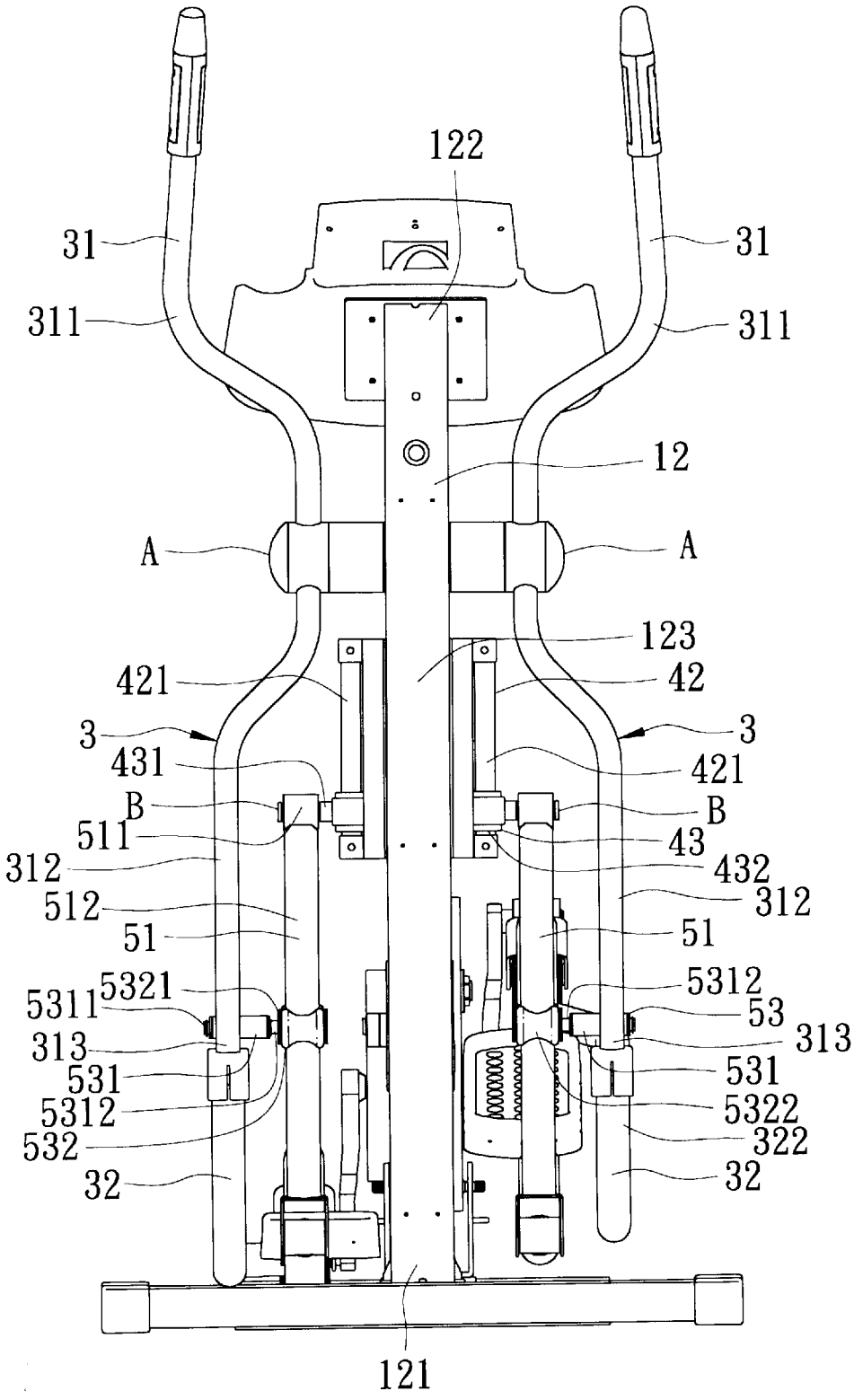
FIG. 2 is a front view of the preferred embodiment.

Referring to FIGS. 1 and 2, the preferred embodiment of the exercising device according to the present invention is shown to comprise a support frame 1, a transmitting mechanism 2, a pair of swing mechanisms 3, a path adjusting mechanism 4, a pair of treading mechanisms 5, a pair of motion guiding members 54, and a pair of synchronizing members 53.

The support frame 1 includes a base support 11 which is adapted to be placed on a ground and which has front and rear portions opposite to each other in a longitudinal direction. A front mounting post 12 is disposed on and extends upwardly from the front portion of the base support 11, and includes lower and upper segments 121,122 opposite to each other in an upright direction and respectively proximate to and distal from the front portion, and an intermediate segment 123 which is interposed between the lower and upper segments 121,122. A rear mounting post 13 is disposed on and extends upwardly from the rear portion of the base support 11.

Each of the swing mechanisms 3 includes a hand operated member 31 and a first coupler member 32. The hand operated member 31 is mounted on and is pivotable relative to the upper segment 122 of the front mounting post 12 about a first fulcrum axis (A), and includes handle and lever portions 311,312 which are disposed respectively at opposite sides of the first fulcrum axis (A). The lever portion 312 is swung by the handle portion 311, extends downwardly, and terminates at a distal end 313. The first coupler member 32 includes a first front coupling end 322 which is connected to the distal end 313, and a first intermediate portion 323 which extends rearwardly from the first front coupling end 322 and which terminates at a first rear coupling end 321. As such, the first intermediate portion 323 proceeds with a first reciprocating movement when the lever portion 312 is swung.

The transmitting mechanism 2 includes a pair of crank members 22 and a flywheel unit 21. Each of the crank members 22 includes a crankpin 221 which is pivoted to the first rear coupling end 321 of the first coupler member 32 of the respective swing mechanism 3 about a first pivot axis parallel to the first fulcrum axis (A), a crank arm 222 which has a proximate arm end that is connected to the crankpin 221, and a distal arm end that extends from the proximate arm end radially relative to the first pivot axis, and a crankshaft 223 which is pivoted to the distal arm end about a second pivot axis parallel to the first pivot axis. The flywheel unit 21 is mounted on and rotates with the crankshaft 223 about the second pivot axis in a known manner.

Figure 5:
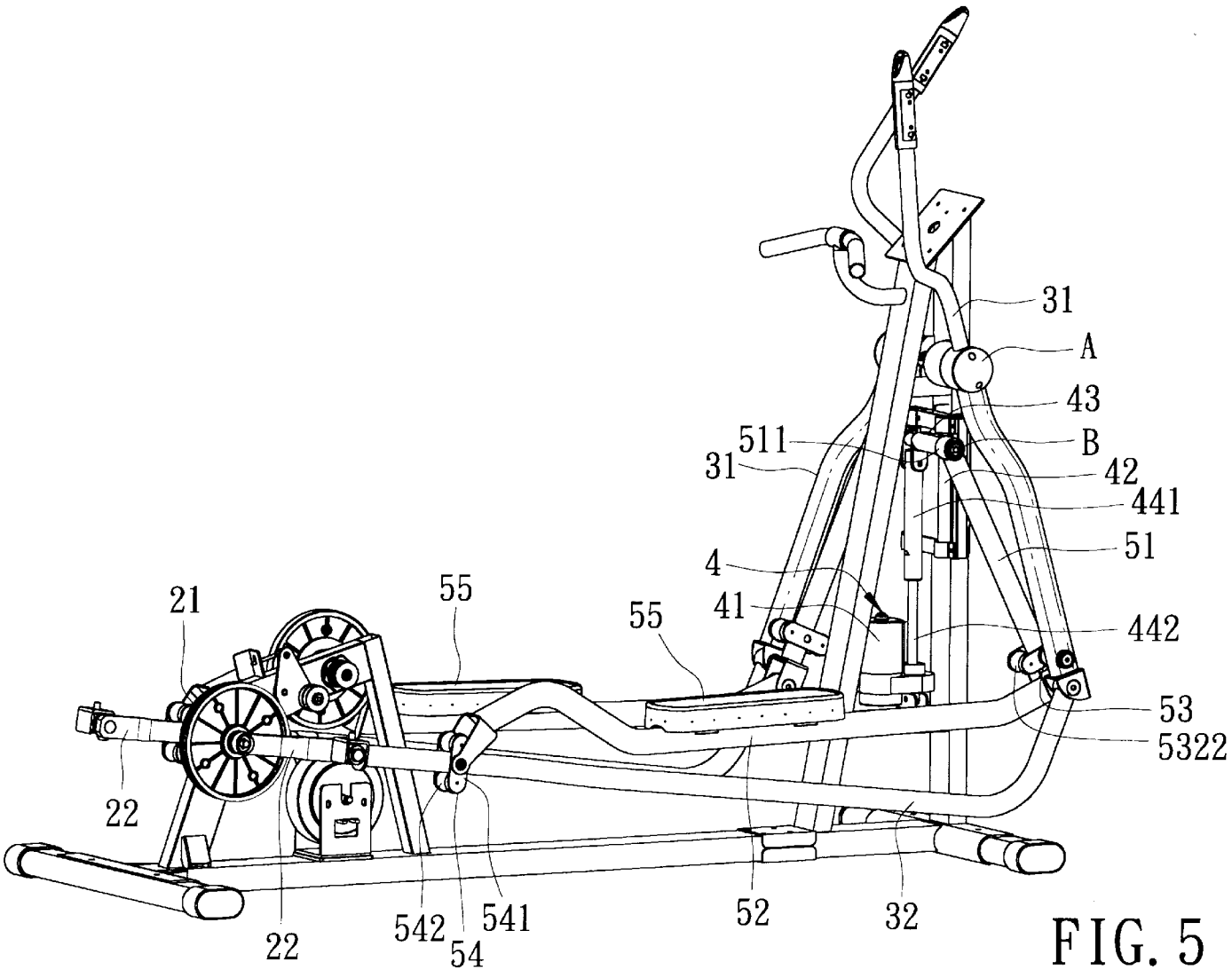
FIG. 5 is a perspective view showing the preferred embodiment when configured to generate a smaller elliptical path of foot movement.

With reference to FIGS. 2 and 5, the path adjusting mechanism 4 includes a motor 41 which is mounted on the front portion of the base support 11 and which has a drive shaft, a guiding seat 42 secured on the intermediate segment 123 of the front mounting post 12, a mounting member 43, and a threaded bolt 442. The threaded bolt 442 is mounted on the front portion of the base support 11, and is coupled to and is driven by the drive shaft of the motor 41 to rotate relative to the base support 11 about an upright axis in an upright direction. The guiding seat 42 has a pair of uprightly extending guiding rods 421. The mounting member 43 has an uprightly extending sleeve 441 with an internally threaded surface which engages threadedly the threaded bolt 442, and a pin portion 431 which extends along a second fulcrum axis (B) parallel to the first fulcrum axis (A) and which has two holes 432 for passage of the guiding rods 421. Thus, rotation of the threaded bolt 442 by the drive shaft of the motor 41 results in linear movement of the mounting member 43 along the upright axis.

Each of the treading mechanisms 5 includes a lever member 51 and a second coupler member 52. The lever member 51 includes a proximate lever end 511 which is journalled on the pin portion 431 of the mounting member 43, and a middle lever segment 512 which extends from the proximate lever end 511 and which terminates at a distal lever end 513. Accordingly, the lever member 51 is pivotally mounted relative to the intermediate segment 123 of the front mounting post 12 about the second fulcrum axis (B). Particularly, the proximate lever end 511 is adjustably connected to the intermediate segment 123 so as to adjust position of the second fulcrum axis (B) relative to the intermediate segment 123. The second coupler member 52 includes a second front coupling end 522 which is connected to the distal lever end 513 of the lever member 51, and a second intermediate portion 523 which extends rearwardly from the second front coupling end 522 and which terminates at a second rear coupling end 521. A foot pad 55 is mounted on the second intermediate portion 523 and is adapted for a user to be treaded by the user to proceed with a second reciprocating movement in the longitudinal direction, thereby swinging the middle lever segment 512 of the lever member 51 about the second fulcrum axis (B).

Each of the motion guiding members 54 includes a roller mounting seat 541 which is secured to the second rear coupling end 521 of the second coupler member 52 of the respective treading mechanism 5, and a pair of rollers 542 which are pivotally mounted on the roller mounting seat 541 and which are in rotatable contact with two opposite sides of the first intermediate portion 323 of the first coupler member 32 of the respective swing mechanism 3. Thus, when the second intermediate portion 523 of the second coupler member 52 proceeds with the second reciprocating movement, the corresponding motion guiding member 54 is in slidable contact with the first intermediate portion 323 in the longitudinal direction so as to move towards or away from the first rear coupling end 321 of the respective first coupler member 32.

With reference to FIGS. 1 and 2, each of the synchronizing members 53 includes a linking bar 531 and a roller unit 532. The linking bar 531 has a first linking end 5311 which is journalled on the distal end 313 of the lever portion 312 of the respective swing mechanism 3 about a third pivot axis parallel to the second fulcrum axis (B), and a second linking end 5312 which is disposed opposite to the first linking end 5311 along the third pivot axis. The roller unit 532 includes a roller mounting seat 5321 which is secured to the second linking end 5312, and a pair of rollers 5322 which are pivotally mounted on the roller mounting seat 5321 and which are respectively in rotatable contact with two opposite sides of the middle lever segment 512 of the lever member 51 of the respective treading mechanism 5.

Figure 3:
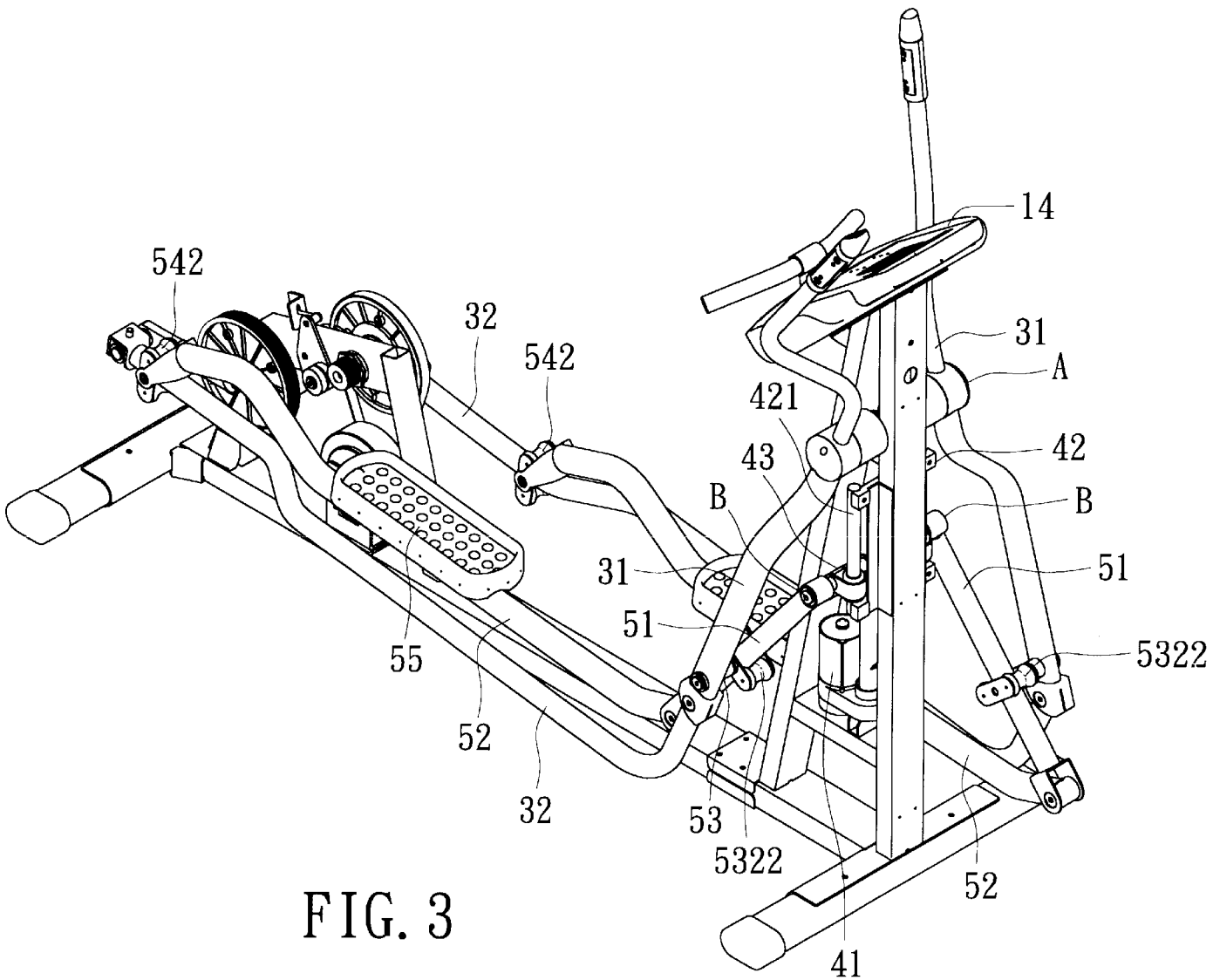
FIG. 3 is a perspective view showing the preferred embodiment in a state where first and second coupler members thereof proceed synchronously with first and second reciprocating movements.
Figure 4:
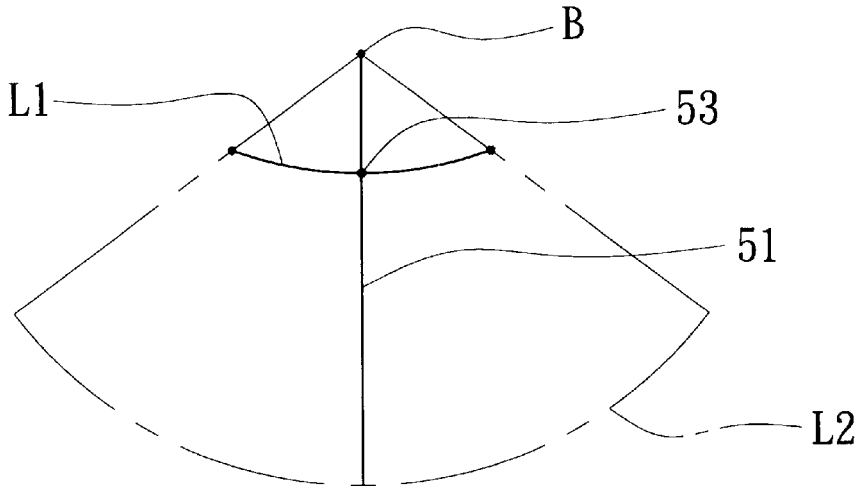
FIG. 4 is a schematic view showing the position of a synchronizing member relative to a lever member of FIG. 3.
Figure 6:
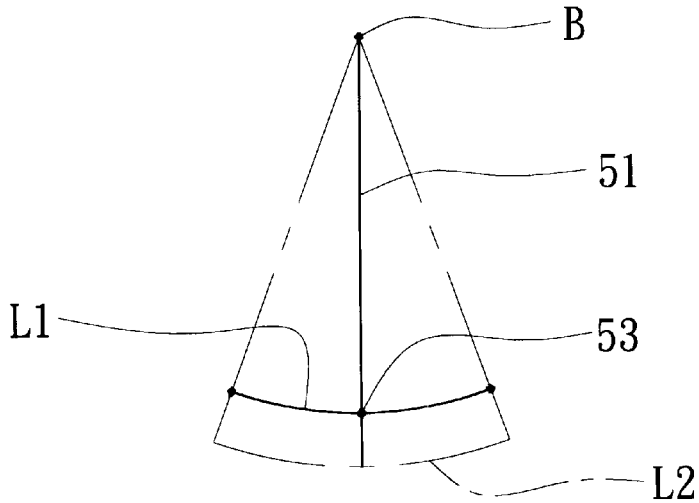
FIG. 6 is a schematic view showing the position of the synchronizing member relative to the lever member of FIG. 5.

As such, referring to FIG. 3, when the user grasps the handle portions 311 and applies forward and backward forces on the foot pads 55, the lever portions 312 are swung about the first fulcrum axis (A) to permit the first intermediate portions 323 of the first coupler members 32 to proceed with the first reciprocating movement. At the same time, by means of the synchronizing members 53, the second intermediate portions 523 of the second coupler members 52 proceed with the second reciprocating movement synchronously in the direction of movement, thereby rendering the second coupler members 52 to run along an elliptical path when the crank arms 222 of the crank members 22 rotate about the second pivot axis. On the other hand, by virtue of the synchronizing members 53, the elliptical path is restrained. In particular, as shown in FIGS. 4 and 6, since the swing path (L1) of the synchronizing member 53 is fixed, the larger the distance between the second fulcrum axis (B) and the respective synchronizing member 53, the smaller will be the elliptical path (L2).

Hence, referring to FIGS. 1 and 5, when it is desired to reduce the elliptical path (L2), that is, to increase the distance between the second fulcrum axis (B) and the synchronizing member 53, the user can actuate the motor 41 by means of an operating panel 14 mounted on the upper segment 122 of the front mounting post 12 to rotate the threaded bolt 442 so as to raise the mounting member 43. At the same time, the second fulcrum axis (B) is lifted so as to be remote from the respective synchronizing member 53. A reduced elliptical path (L2) is thus achieved.

As illustrated, by adjusting the position of the second fulcrum axis (B) relative to the front mounting post 12, the elliptical path of the second coupler members 52 can be adjusted conveniently during exercising. Moreover, since the second coupler members 52 are connected to the respective first coupler members 32 by means of the motion guiding members 54, the second rear coupling ends 521 do not project rearwardly of the support frame 1, thereby resulting in a reduction in the total length of the exercising device and improvement in the outer appearance of the same. Furthermore, by virtue of the roller units 532, the linear displacement of the lever members 51 during adjustment of the second fulcrum axis (B) can be kept smooth and steady.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. An exercising device comprising:

a base support adapted to be placed on a ground, and having front and rear portions opposite to each other in a longitudinal direction;

a front mounting post disposed on and extending upwardly from said front portion, and including lower and upper segments opposite to each other in an upright direction and respectively proximate to and distal from said front portion, and an intermediate segment interposed between said lower and upper segments;

a rear mounting post disposed on and extending upwardly from said rear portion;

a hand operated member mounted on and pivotable relative to said upper segment of said front mounting post about a first fulcrum axis, and including handle and lever portions disposed respectively at opposite sides of the first fulcrum axis, said lever portion being swung by said handle portion, extending downwardly, and terminating at a distal end;

a first coupler member including a first front coupling end which is connected to said distal end, and a first intermediate portion which extends rearwardly from said first front coupling end and which terminates at a first rear coupling end, said first intermediate portion proceeding with a first reciprocating movement when said lever portion is swung;

a crank member including a crankpin which is pivoted to said first rear coupling end about a first pivot axis parallel to the first fulcrum axis, a crank arm which has a proximate arm end that is connected to said crankpin, and a distal arm end that extends from said proximate arm end radially relative to the first pivot axis, and a crankshaft which is pivoted to said distal arm end about a second pivot axis parallel to the first pivot axis and which is mounted on and which is rotatable relative to said rear mounting post about the second pivot axis;

a lever member including a proximate lever end which is pivotally mounted relative to said intermediate segment of said front mounting post about a second fulcrum axis parallel to the first fulcrum axis, and a middle lever segment which extends from said proximate lever end and which terminates at a distal lever end;

a second coupler member including a second front coupling end which is connected to said distal lever end of said lever member, and a second intermediate portion which extends rearwardly from said second front coupling end and which terminates at a second rear coupling end, said second intermediate portion being adapted to be treaded to proceed with a second reciprocating movement in the longitudinal direction, thereby swinging said middle lever segment of said lever member about the second fulcrum axis;

a motion guiding member connected to said second rear coupling end of said second coupler member, and in slidable contact with said first intermediate portion of said first coupler member in the longitudinal direction so as to move relative to said first rear coupling end when said second intermediate portion of said second coupler member proceeds with the second reciprocating movement; and a synchronizing member disposed to couple said distal end of said lever portion with said middle lever segment of said lever member, such that the first and second reciprocating movements are synchronized in the direction of movement, thereby rendering said second coupler member to run along an elliptical path when said crank arm of said crank member rotates about the second pivot axis.

2. The exercising device of claim 1, further comprising a flywheel which is mounted on and which rotates with said crankshaft about the second pivot axis.

3. The exercising device of claim 1, wherein said proximate lever end of said lever member is adjustably connected to said intermediate segment in the upright direction so as to adjust position of the second fulcrum axis relative to said intermediate segment.

4. The exercising device of claim 3, further comprising a threaded bolt mounted on and rotatable relative to said front portion of said base support about an upright axis in the upright direction; and a mounting member having an internally threaded surface which extends along the upright axis and which engages threadedly said threaded bolt, and a pin portion which extends along the second fulcrum axis, said proximate lever end being journalled on said pin portion, said pin portion being movable along and non-rotatable about the upright axis such that rotation of said threaded bolt results in linear movement of said pin portion and said proximate lever end along the upright axis.

5. The exercising device of claim 4, further comprising a motor with a drive shaft coupled to drive said threaded bolt to rotate about the upright axis.

6. The exercising device of claim 1, wherein said synchronizing member includes a linking bar having a first linking end which is journalled on said distal end of said lever portion about a third pivot axis parallel to the second fulcrum axis, and a second linking end that is disposed opposite to said first linking end along the third pivot axis, and a roller unit including a roller mounting seat which is secured to said second linking end, and a pair of rollers which are pivotally mounted on said roller mounting seat and which are respectively brought into rotatable contact with two opposite sides of said middle lever segment of said lever member.

7. The exercising device of claim 1, wherein said motion guiding member includes a roller mounting seat which is secured to said second rear coupling end of said second coupler member, and a pair of rollers which are pivotally mounted on said roller mounting seat and which are in rotatable contact with two opposite sides of said first intermediate portion of said first coupler member.

8. The exercising device of claim 1, further comprising a foot pad which is mounted on said second intermediate portion of said second coupler member.

* * * * *